US005983500A

United States Patent [19]

da Silva

[11] Patent Number: 5,983,500

[45] Date of Patent: Nov. 16, 1999

[54] DISPOSABLE FOAMING RAZOR WITH COMBINATION FEED DIALS

[76] Inventor: Jean-Pierre da Silva, 6153 S. Rodeo La., Salt Lake City, Utah 84121

[21] Appl. No.: 08/815,840

[22] Filed: Mar. 12, 1997

[51] Int. Cl.[6] ..... B26B 19/44

[52] U.S. Cl. ..... 30/41; 30/125; 30/535

[58] Field of Search ..... 30/41, 41.5, 124, 30/125, 123.3, 535

[56] References Cited

U.S. PATENT DOCUMENTS

| | | | |
|---|---|---|---|
| 1,950,769 | 3/1934 | Baar | 30/41 |
| 2,120,940 | 6/1938 | Minassian . | |
| 2,336,806 | 12/1943 | Schenk et al. | 30/41 |
| 2,747,273 | 5/1956 | Olsson . | |
| 2,790,234 | 4/1957 | Goldstein | 30/41 |
| 3,349,484 | 10/1967 | Zeles . | |
| 3,703,765 | 11/1972 | Perez . | |
| 4,238,882 | 12/1980 | Harrison, Sr. . | |
| 4,653,188 | 3/1987 | Kwak . | |
| 4,753,006 | 6/1988 | Howe | 30/41 |
| 4,809,432 | 3/1989 | Schauble . | |
| 4,868,982 | 9/1989 | McComas | 30/41 |
| 5,070,611 | 12/1991 | Derin et al. . | |
| 5,072,512 | 12/1991 | Noujain . | |
| 5,269,062 | 12/1993 | Dallaire et al. . | |
| 5,337,478 | 8/1994 | Cohen et al. . | |
| 5,384,961 | 1/1995 | Gregory . | |

FOREIGN PATENT DOCUMENTS

| | | | |
|---|---|---|---|
| 152005 | 6/1953 | Austria | 30/41 |
| 860726 | 1/1941 | France | 30/41 |
| 471884 | 9/1937 | United Kingdom | 30/41 |

*Primary Examiner*—Hwei-Siu Payer
*Attorney, Agent, or Firm*—Trask, Britt & Rossa

[57] ABSTRACT

The present invention relates to a shaving razor which has been engineered to eject a flowable lubricant onto a skin surface upon demand. The razor has a hollow handle neck and head and lubricant feed mechanism. The feed mechanism utilizes a piston which moves upward in the hollow handle to force lubricant through the neck and head of the razor to be injected near a blade fixed to the razor head.

2 Claims, 5 Drawing Sheets

DISPOSABLE FOAMING RAZOR WITH COMBINATION FEED DIALS

BACKGROUND OF THE INVENTION

1. Field of the Invention

The invention relates to a shaving razor, and more particularly to a disposable razor containing a shaving lubricant with a hand-activated feed mechanism.

2. State of the Art

Disposable razors containing a shaving lubricant are generally known in the art. These fall into several categories, namely: razors having a pressurized canister (see Cohen, U.S. Pat. No. 5,337,478, Dallaine, U.S. Pat. No. 5,269,062, and Zeles U.S. Pat. No. 3,349,484, for example); manually-operated pusher mechanisms (see Perez, U.S. Pat. No. 3,703,765 and Kwak, U.S. Pat. No. 4,653,188, for example); razors having a lubricant contained within the razor head (see Narijan, U.S. Pat. No. 5,072,512) and razors having flexible sac members to pneumatically propel the lubricant (see Schauble, U.S. Pat. No. 4,809,432 and Olson U.S. Pat. No. 2,747,273)

The various mechanisms disclosed in the above-identified patents have their respective advantages and disadvantages. Pressurized containers tend to eject too much foam, at first, and too little later in their use, thus lacking a positive manual control. Razors containing lubricant in the razor head, rather than the handle, must have a bulky head in order to contain an adequate supply of lubricant. This may cause the razor to lack the typical balance of a conventional disposable, safety razor.

Razors with flexible membranes within the handle tend to provide a more controllable positive displacement of shaving lubricant than pressurized containers when manually pressed but may be less controllable when pneumatically actuated. Also, the membrane may become wrinkled or otherwise be difficult to press and cause a malfunction of the device.

SUMMARY

The instant invention relates to a disposable safety razor containing a beard-lubricating fluid within the handle and manual actuator means for forcing said fluid to the razor head upon demand. The razor has a hollow handle with an interior elongated cavity having a cross-sectional area of substantially uniform dimension and shape over the length of said cavity. A piston, also denominated herein as a "pusher plate" is caused to moved from the lower extremity of the cavity towards the upper portion of said cavity in response to manual actuation of the actuator means and thus force the lubricating fluid upward through the cavity and into a hollow neck connected to the razor head which has one or more pores through which the lubricating fluid may flow to pass beneath or above a single blade or alternatively, between parallel-placed, dual blades. The razor may be equipped with one or more manual actuators over the length of the cavity. The cavity preferably has a non-circular shape so that a pusher plate of the same shape as the cross-section will advance upward in the cavity without rotating or turning.

DETAILED DESCRIPTION OF THE INVENTION

The instant invention is illustrated in the attached figures which set forth various preferred embodiments of the structure of the complete disposable safety razor containing a lubricating fluid, e.g. gel, foam or the like.

Figure 1:
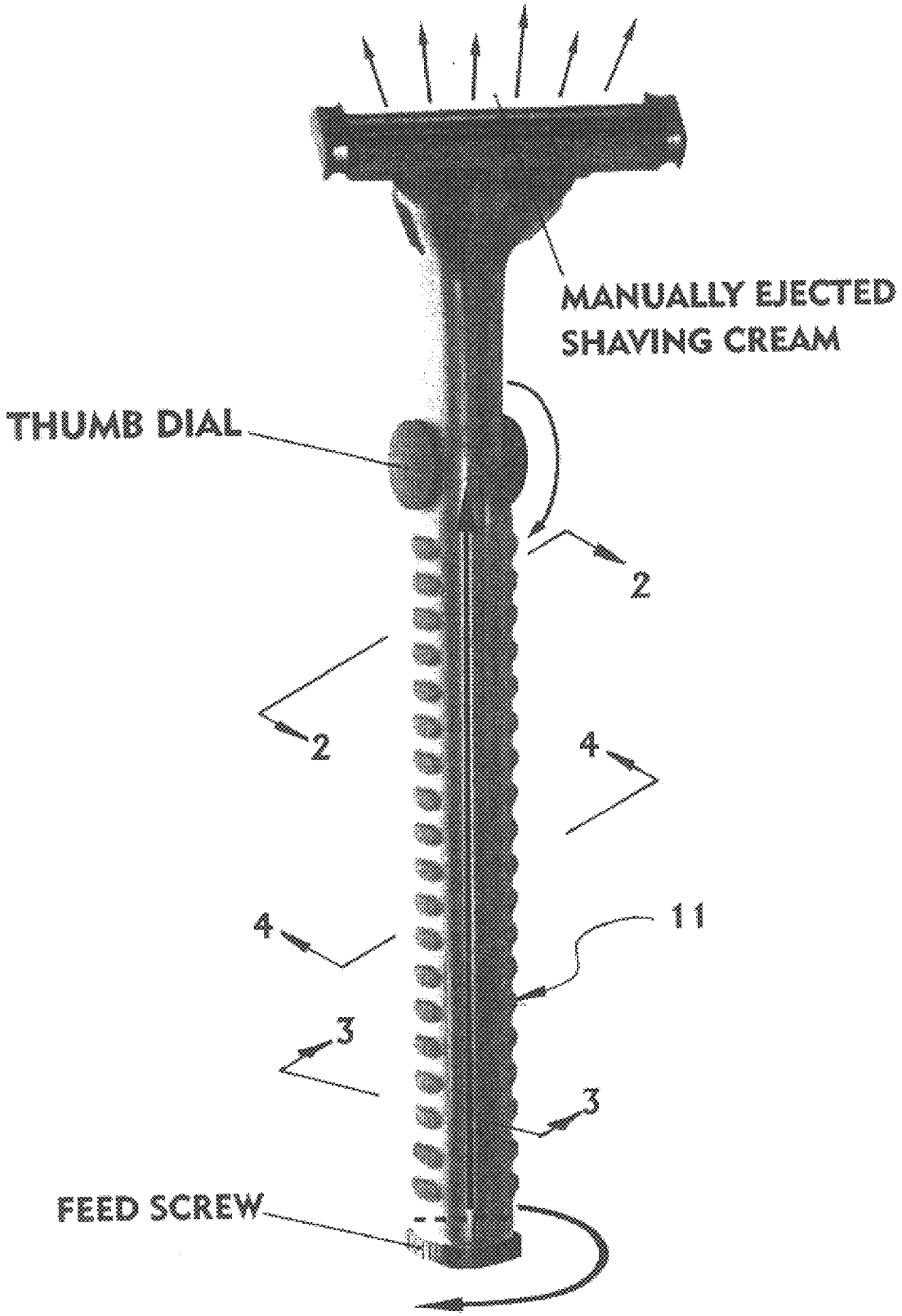
FIG. 1 is an elevational external view of the disposable safety razor of the instant invention in which ejectable shaving lubricant is contained in its handle.

The razor of the instant invention is illustrated in FIG. 1. It generally has the general appearance of a safety razor. The indicators of a differently functioning razor are the thumb dials (knobs) adjacent the razor neck, near the top of the handle portion 11 and the thumb knob at the base of the handle.

The pusher plate 13 has a central aperture (see FIG. 2) which interacts with a threaded rod (feed screw) 14 which runs the length of handle cavity 12. The pusher plate (piston) 13 is advanced along the feed screw 14 by turning rotatable thumb knob 15 fixed to the base of the feed screw 14. The top of the feed screw rests in a vertically-oriented journal 16, which is an elongated bore sized to receive the unthreaded upper end of the feed screw. The feed screw is a stiff (rigid) slender member.

The thumb knob preferably has sealing means which permits the knob to be rotated with reference to the razor handle's fixed base insert 17 without the loss of lubricating fluid around the junction of the knob and handle. The handle base has an opening (base hole) in it through which an axle attached to the thumb knob passes. The axle diameter may be close to the diameter of the base opening so that very little, if any, lubricant, e.g., a gel, leaks from the base, especially since the piston is above the handle base. The lubricating fluid, e.g. a gel, is generally sufficiently viscous that it can be readily retained in the handle cavity with simple sealing means. The handle cavity 12 containing the lubricating fluid communicates with an open throat 18 in the neck 19 of the razor through which the fluid readily moves when under an upward pressure (force) to flow, ultimately, through a pore or pores in the razor head.

Figure 2:
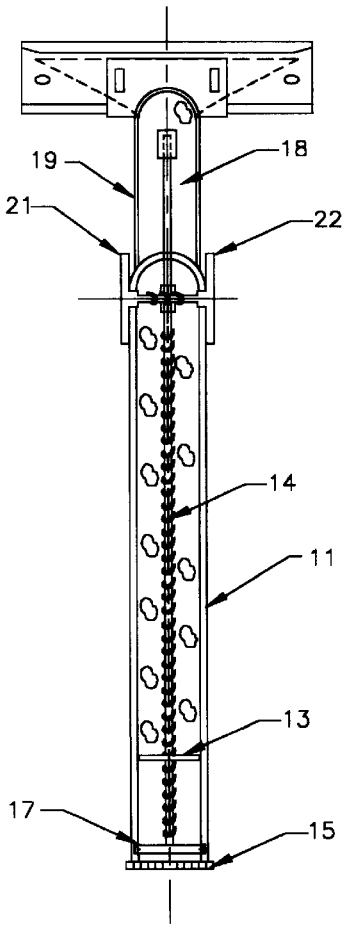
FIG. 2 is a sectional, elevational view of the razor of FIG. 1 along section lines 2—2.
Figure 3:
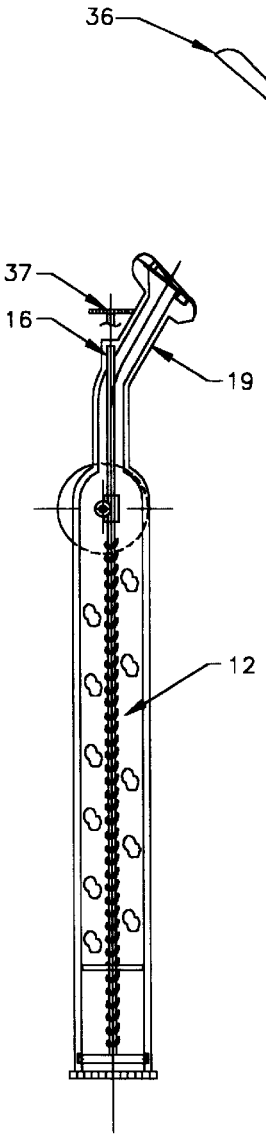
FIG. 3 is a sectional, elevational view of the razor of FIG. 1 along section lines 3—3.

A supplemental, or alternative, means for turning the feed screw 14 and advancing the piston 13 and lubricating fluid is illustrated in FIGS. 1, 2 and 3. This alternative means employs a worm gear 20 positioned transverse to and engaging the feed screw. Each end of the worm gear is smooth and projects through the handle sidewalls at or near the upper end of the fluid cavity. Thumb dials (knobs) 21 and 22 are attached securely to each end of the worm gear. The position of these thumb knobs (one or, preferably, two knobs may be used) near or at the upper portion of the razor handle to permit easy turning of such thumb knobs while the razor is gripped in one's hand with one's thumb being juxtaposed to one or the other knob. Having a pair of knobs at such upper handle position makes the razor easily used by either a right-handed or left-handed person. However, a single thumb dial (knob) is effective when placed on the front or back of the handle with the worm gear then oriented transverse to the front and back of the handle. (See FIG. 6.) Thus, such a single knob may be easily turned by either a left- or right-handed person using the razor.

Another way of using a single rotatable knob is to extend said feed screw upper shaft above said journal and secure a thumb knob to its end. Such a top-mounted knob 37 (see FIG. 3) may also be easily used by either a right- or left-handed person. Such a top-mounted knob may be used in conjunction with or in place of other actuator knobs.

The smooth spindle ends of the worm gear may fit relatively snugly in the opposed ports in the opposed handle sidewalls to preclude fluid leakage. Generally, the smooth spindle ends have a diameter which is slightly greater than the maximum thread diameter of the worm gear so that the worm gear may be easily inserted through one or the other sidewall ports during assembly of the unique razor of the instant invention.

The dual knob means for advancing the piston via turning of the feed screw may be used with or instead of the bottom thumb knob. If the bottom thumb knob is omitted, a simple cap or blank insert is used to close the lower end of the razor handle.

The lubricant cavity in the razor handle communicates with the razor head 2 through an open hollow throat in the neck of the razor.

The complete razor may be constructed as one piece or of several independent elements. The handle element, for example, is preferably formed as one piece. The handle element, in one embodiment, is a tubular member having a non-round internal cross-sectional shape which is uniform over the entire internal length of the handle over which a piston member would travel. The handle is open at its upper end and may be open or closed at its bottom end. If the bottom is closed, a small bore hole (internal) is required to receive the bottom end of the feed screw.

The neck of the razor may also be a separate structure. The lower end of the neck attaches to the upper end of the handle. The neck, as well as the handle, may be made of two mirror-like structures which press together to form the complete element. The neck has a hollow throat. The neck preferably has a journal bore to receive the upper end of the feed screw.

The juncture between the neck and handle may be the location of the transverse worm gear. The worm gear may be placed in position when the neck and handle are joined together.

The handle cavity may be filled with lubricant before or after the neck and handle are joined. The feed screw and piston are preferably in place with the piston located at the bottom of the cavity at the time the lubricant is placed in the cavity.

The lubricant may be placed on the handle cavity by injection through pores in the razor head by a needle-like injector. A viscous lubricant, e.g., gel, can be made more fluid by heating the gel to a temperature significantly greater than room temperature.

Figure 5:
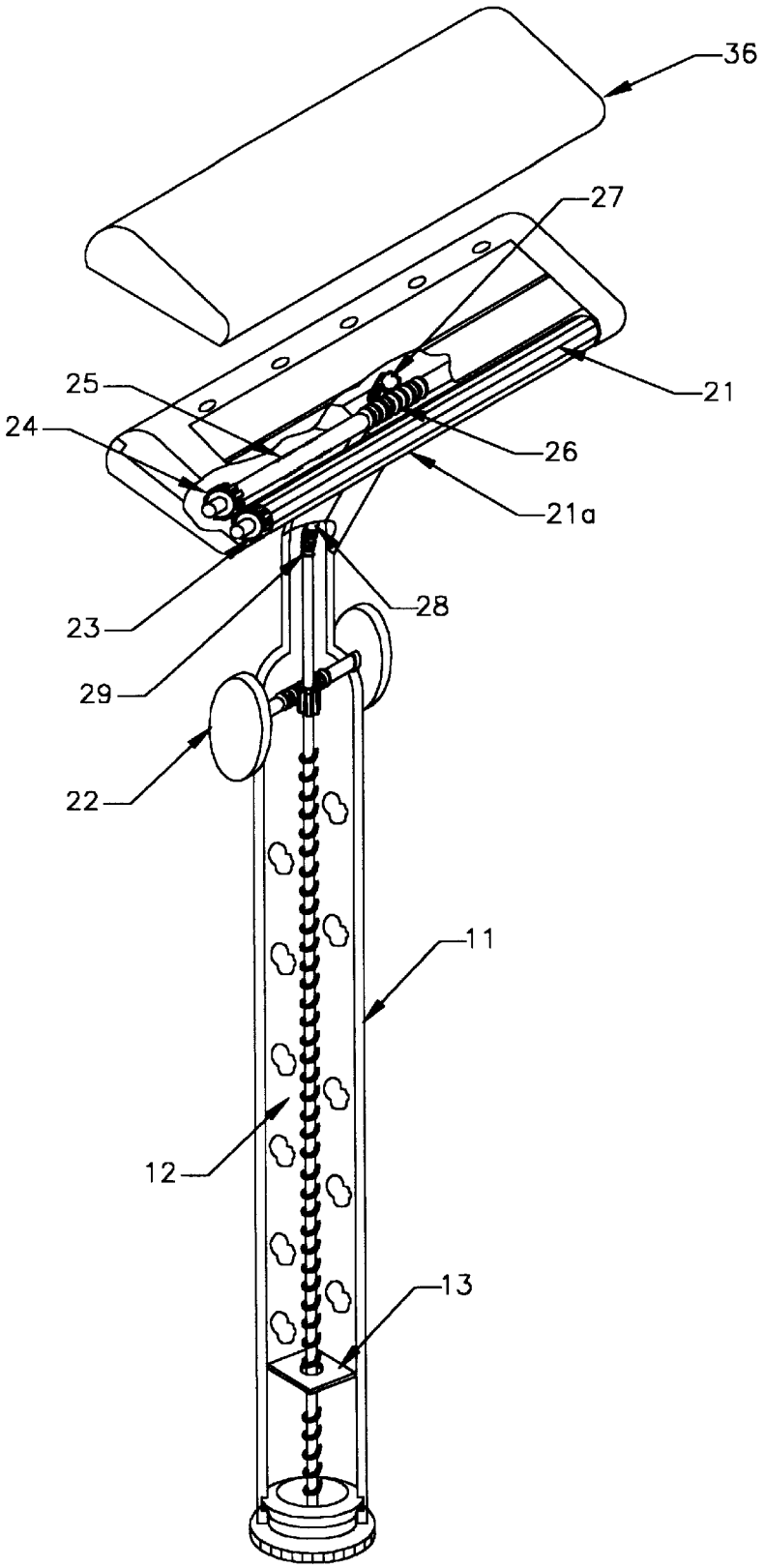
FIG. 5 is a sectional, elevational view of a razor of the type illustrated in FIG. 1 with an additional or alternative lubricant feed mechanism actuated by rollers in the razor head.

The razor blade embodiment illustrated in FIG. 5 has a roller mechanism included in the razor head. The roller mechanism includes an outer roller 21 with transverse vanes 21*a* running the length of the roller which is positioned forward of the razor blades so that the vaned roller 21 contacts the skin of a user when the razor head 2 is in a shaving position adjacent the skin. As the razor head is drawn across and in contact with the skin, the vaned roller 21 rotates, which causes its gears (sprockets) 23 at each end to rotate and engage the gears 24 on the worm gear shaft 25 which causes the worm gear 26 in the razor head to rotate.

The worm gear shaft 25 and the roller mechanism 21 are in a permanently spaced, parallel relationship, with the ends of each shaft held within the razor head in a manner to permit rotation of each shaft.

Rotation of the worm gear 26, which engages a sprocket 27 in the upper feed screw shaft 28, causes said upper feed screw shaft 28 to rotate via the sprocket 27 of the upper, angled feed screw shaft 28. The upper feed screw shaft 28 is separate from the lower feed screw shaft but is joined to it by a coil spring 29. The coil spring 29 is structured to bend so that it accommodates the angular connection between the upper feed screw shaft 28, located in the razor throat and the lower feed screw shaft which is axially aligned with the vertical axis of the razor handle. The spring thus forms an arc with the spring being slightly compressed at the inside of said arc and being slightly expanded at the outside of the arc. Thus, structured, the spring allows the rotation of the upper feed screw shaft to rotate the lower feed screw shaft without any substantial lateral displacement or binding of either shaft.

The top end of the upper feed screw shaft 28 is contained within a journal (not illustrated) so that the sprocket 27 and worm gear 26 maintain good contact with one another. The lower end of said shaft 28 is the free end which engages the coil spring.

Figure 4:
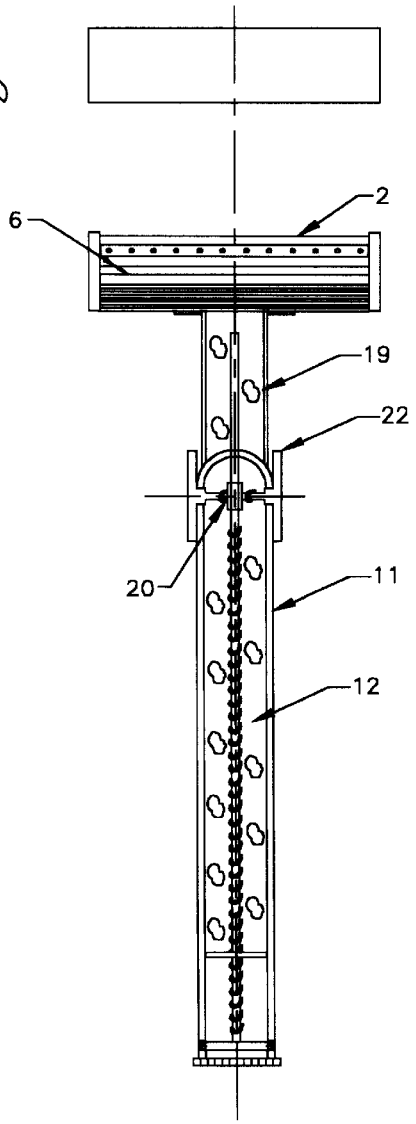
FIG. 4 is a sectional, elevational view of the razor of FIG. 1 along section lines 4—4.

The feed mechanism of FIG. 5 may be used in conjunction with, or instead of, the thumb dial-actuated feed mechanism illustrated in FIGS. 2, 3, and 4.

Figure 6A:
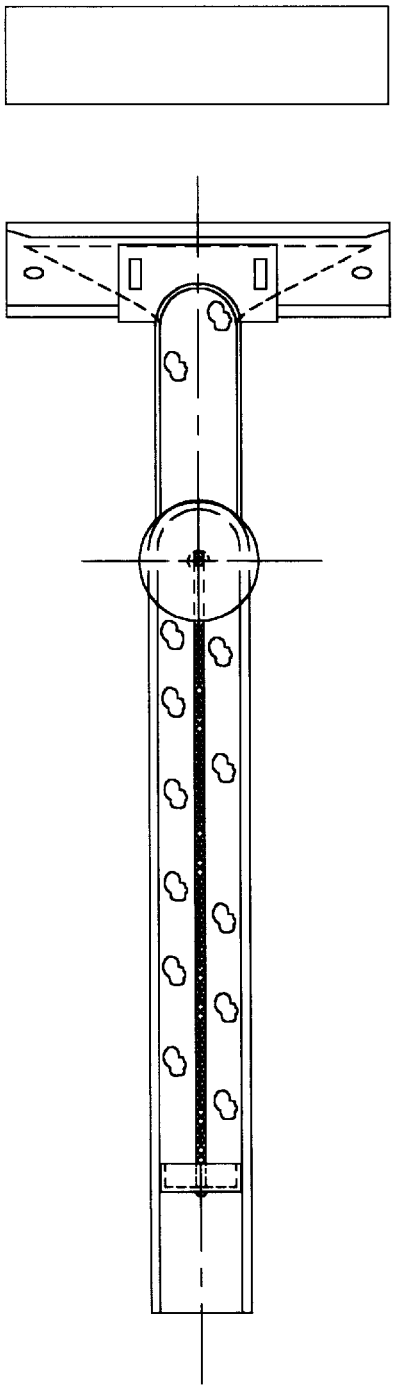
FIG. 6A and 6B is a razor of the general type illustrated in FIG. 1 illustrated in a sectional, elevational view with a single thumb knob at the back of the razor handle wherein lubricant feed mechanism includes windlass.
Figure 6B:
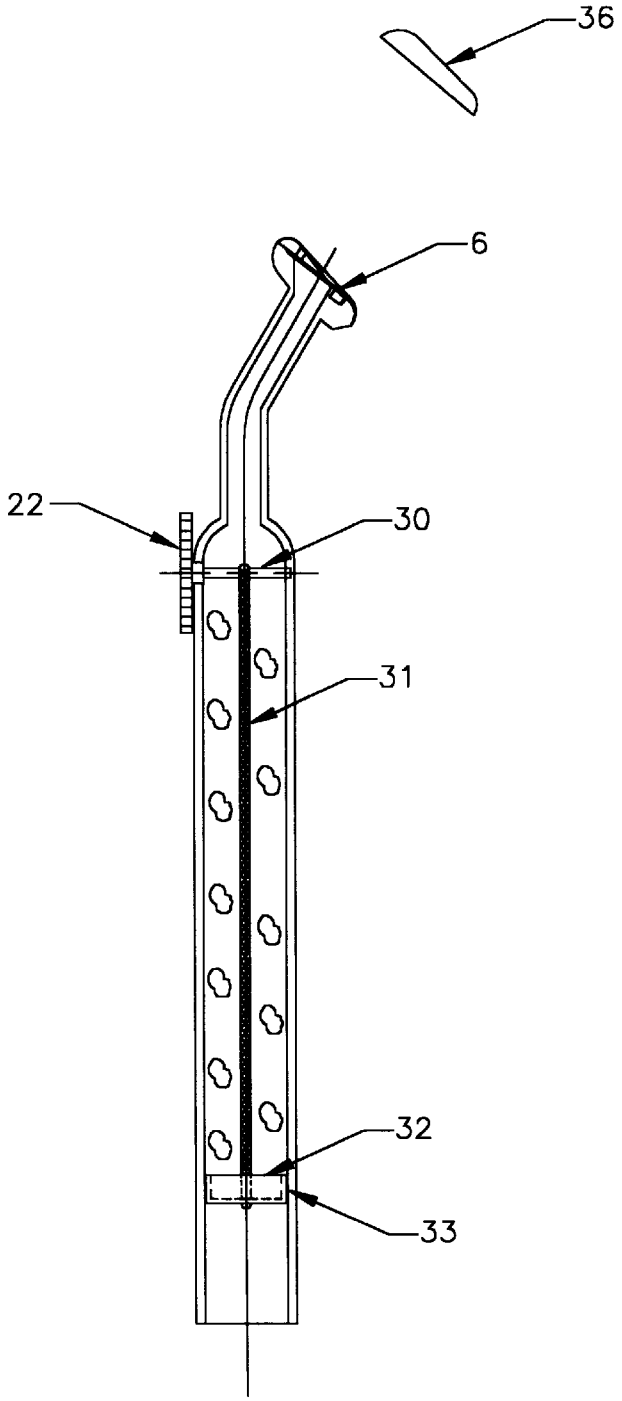

The razor illustration of FIG. 6A and 6B illustrated a feed mechanism in which the thumb dial (knob) 37 is positioned directly behind the handle. This embodiment permits easy actuation, i.e., turning of the thumb dial by either hand, thus accommodating use by a left- or right-handed person with equal ease.

The feed mechanism illustrated in FIG. 6B has a transversely (fore-aft) positioned windlass 30 located within the upper part of the razor's hollow handle. A flexible cord 31 is fixed to the windlass at one end and to a piston 32 at its other (lower) end. Rotation of the windlass by an external thumb knob winds the cord about the windlass, pulling the piston upwards in the handle's internal chamber thereby causing lubricant to be displaced upward in the hollow handle to pass through the razor throat and to discharge through the opening in the razor head to be available to lubricate the razor blades 6 and skin during use of the razor. The piston 32 of FIG. 6B has a depending skirt 33. The skirt 33 depends from the whole periphery of piston 32, although the skirt, to perform its function need not be continuous. The purpose of the skirt to maintain proper alignment of the piston in the handle cavity; i.e., prevent canting of the piston, which could cause it to jam and cause the razor to be ineffective insofar as feeding lubricant is concerned. A skirted piston could be advantageously used with respect to any of the razor embodiments illustrated and described herein.

Figure 7A:
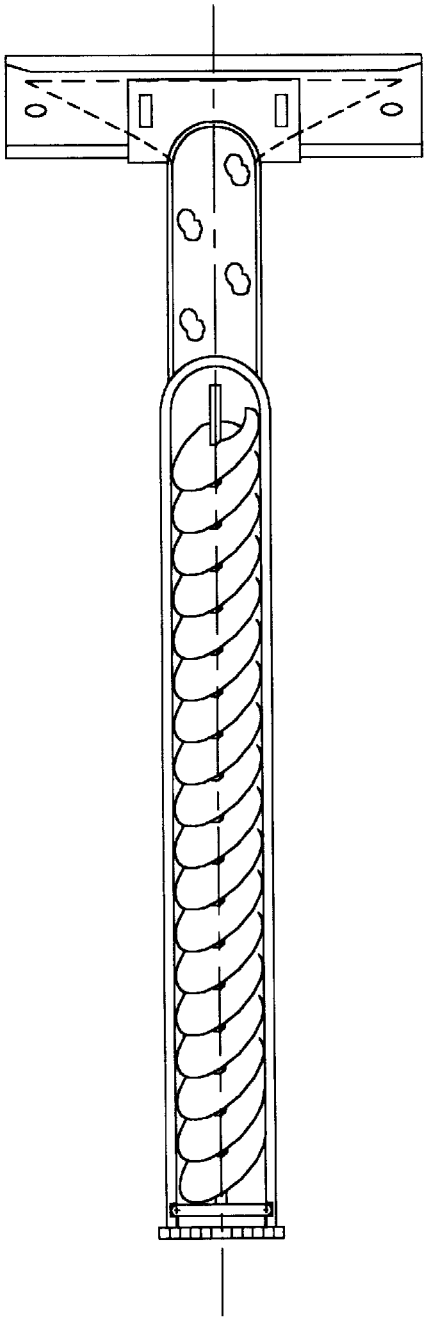
FIG. 7A and 7B is a razor of the general type illustrated in FIG. 1 wherein the lubricant feed mechanism includes a feed auger.
Figure 7B:
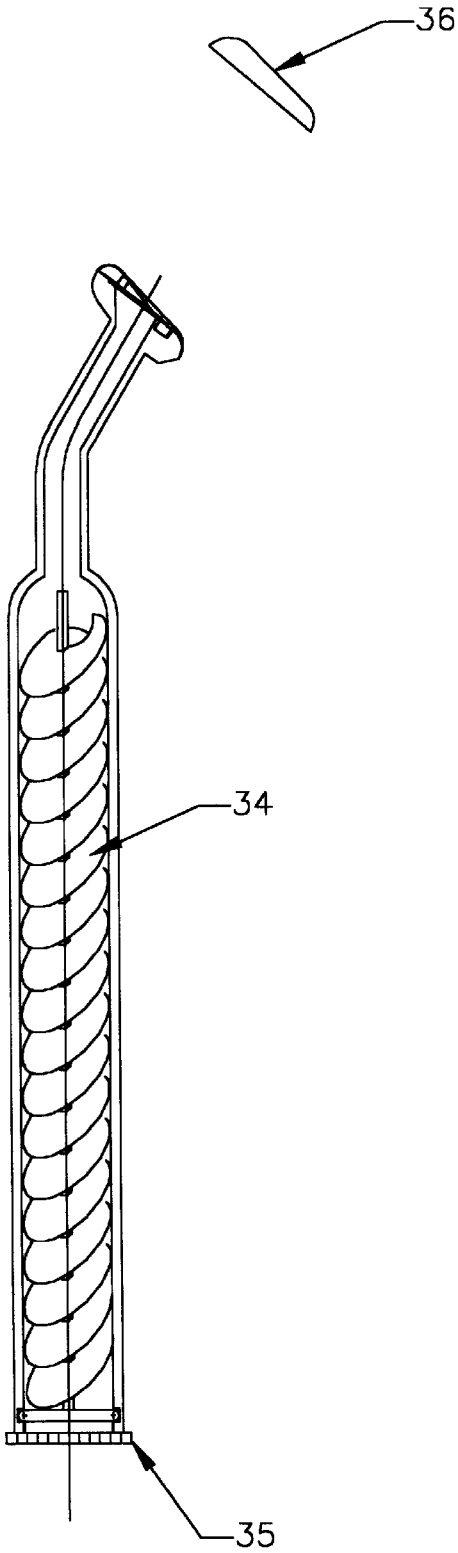

The embodiment of FIG. 7B includes a feed mechanism which is a feed auger 34 disposed in the handle cavity. The auger 34, upon rotation in the proper direction by a bottom-mounted thumb knob 35 feeds lubricant from the handle cavity through the razor throat to the razor head. The worm gear drive mechanisms of FIG. 1 or FIG. 5 can be used effectively with a feed auger.

The razor of the instant invention is advantageous inasmuch as the feed mechanism provides a positive displacement of lubricant in a controllable manner. It further efficiently utilizes a handle-contained lubricant reservoir so that only a small amount of lubricant (that contained in the razor throat) is not expelled from the razor.

The razor described and illustrated herein is further simple to assemble and simple to load with a lubricant, such as a gel. The handle, neck and razor head may be made of plastic in a single injection. The razor throat is open, i.e., a discharge port exists in the head, so that the razor may be assembled with its internal feed screw, bottom handle closure and pusher plate (piston) and then have gel or other lubricant injected through the throat in the handle reservoir.

A safety cap 36 (see FIGS. 1, 5 or 7B) protects the razor blades and may further tend to seal the razor head so that minimal evaporation of any volatile component of the gel (lubricant) occurs.

Typically, disposable razors of this type would be sold in bubble-formed packages which are typically air tight. Thus, substantially no evaporation of gel components would take place during display in a store and the use of the head cap after the razor is removed from its bubble pack then minimize evaporation losses thereafter.

What is claimed is:

1. A disposable razor having a blade and structured and adapted to contain and dispense a flowable (fluid) lubricant material to the region of the razor's blade comprising:

a razor body comprising an elongated hollow handle and a hollow neck, a razor blade holding head mounted on said neck, said head having at least one fluid dispensing opening communicating with said hollow handle via said hollow neck; and a positive displacement fluid dispensing mechanism contained in said handle having a pusher plate (piston) advanceable upwards in said handle by an elongated member disposed substantially vertically in said handle and operatively connected to a hand-moveable actuator having an internal shaft and a knob member positioned externally to said handle, wherein said elongated member is a flexible chord and said internal shaft of said hand-moveable actuator is a windlass to which said chord is attached.

2. The disposable razor of claim 1, wherein the body is a unitary structure.

* * * * *